US009469977B2

(12) United States Patent
Keisel et al.

(10) Patent No.: US 9,469,977 B2
(45) Date of Patent: Oct. 18, 2016

(54) INDEPENDENTLY OPERABLE WATER STORAGE AND DISTRIBUTION SYSTEM

(71) Applicants: Russell Keisel, Mt. Pleasant, UT (US); Kathi Keisel, Mt. Pleasant, UT (US)

(72) Inventors: Russell Keisel, Mt. Pleasant, UT (US); Kathi Keisel, Mt. Pleasant, UT (US)

( * ) Notice: Subject to any disclaimer, the term of this patent is extended or adjusted under 35 U.S.C. 154(b) by 0 days.

(21) Appl. No.: 14/457,156

(22) Filed: Aug. 12, 2014

(65) Prior Publication Data

US 2014/0345721 A1 Nov. 27, 2014

(51) Int. Cl.

| | |
|---|---|
| ***F17D 1/00*** | (2006.01) |
| ***E03B 11/02*** | (2006.01) |
| ***E03B 5/02*** | (2006.01) |

(52) U.S. Cl.

CPC ..... *E03B 11/02* (2013.01); *E03B 5/02* (2013.01); *Y10T 137/86035* (2015.04)

(58) Field of Classification Search

CPC ..... E03B 1/048; E03B 7/04; E03B 11/02; E03B 5/00; Y10T 137/85986; Y10T 137/86002; Y10T 137/86043; Y10T 137/87265; Y10T 137/87322; Y10T 137/6966

USPC ..... 137/356, 572, 590, 590.5, 599.11, 137/599.01, 599.08, 587

See application file for complete search history.

(56) References Cited

U.S. PATENT DOCUMENTS

| | | | | |
|---|---|---|---|---|
| 2,931,382 | A | 4/1960 | Cirillo | |
| 3,095,893 | A | 7/1963 | Martin | |
| 4,718,452 | A * | 1/1988 | Maitland | 137/592 |
| 4,962,789 | A | 10/1990 | Benscoter | |
| 5,597,487 | A * | 1/1997 | Vogel et al. | 210/652 |
| 5,778,471 | A | 7/1998 | Collison | |
| 5,975,133 | A * | 11/1999 | Nalewajski | 137/587 |
| 6,248,242 | B1 * | 6/2001 | Martin | C02F 1/78 141/1 |
| 6,861,033 | B2 * | 3/2005 | Mullins | B01D 61/02 137/14 |
| 8,141,584 | B1 * | 3/2012 | Ellyson | E03B 1/041 126/640 |
| 2003/0117289 | A1 * | 6/2003 | Uhler | 340/606 |
| 2013/0037114 | A1 | 2/2013 | Sudhalkar | |
| 2013/0043365 | A1 | 2/2013 | Harel | |

* cited by examiner

*Primary Examiner* — Jessica Cahill

(74) *Attorney, Agent, or Firm* — Morriss O'Bryant Compagni

(57) ABSTRACT

A water storage system is provided that stores a quantity of fresh, potable water for residential or commercial use when municipal water or ground water is not available. The system comprises several embodiments, including a pressurized system and a non-pressurized system that stores water from a main water line in one or more storage tanks for subsequent use. A solar-powered pump is utilized to pump water from the storage tank or tanks when no electrical power is available, allowing water to be distributed into a dwelling or building to run facilities and to allow for undisturbed operation in the event of a catastrophe or emergency event. Water is continually or operably circulated through the tanks in order to maintain a fresh supply under normal conditions, while the tanks can be isolated from the main water supply in an emergency event.

10 Claims, 4 Drawing Sheets

INDEPENDENTLY OPERABLE WATER STORAGE AND DISTRIBUTION SYSTEM

BACKGROUND OF THE INVENTION

Field of the Invention

The present invention relates to water storage and systems for storing potable water for in-home use in the event of an emergency event. More specifically, the present invention relates to a system that stores fresh water from a water source in a local storage tank, the tank (or tanks) being disposed either outdoors, indoors, or within condensed living quarters and whereby the water is available in the event that a main water supply ceases for a period of time.

Fresh water is an essential resource and a precious commodity for maintaining a livable environment. In both the developing and the developed worlds, access to fresh water is necessary to maintain living standards and allow an area to be populated. In the developed world, most have become accustomed to ready access to fresh, potable water that is supplied directly into their homes to meet their daily needs. However, certain emergency situations and catastrophes can make fresh water sources unavailable for periods of time, which can lead to shortages and panic amongst the population.

Fresh water is used in most homes in order to operate various systems and to provide potable water for food preparation and sustenance. During emergency events, however, access to this abundance of fresh water can be interfered with, potentially causing a shortage of usable water in a given area. Common emergency situations include storm events that can disable water distribution systems, droughts that can dwindle water supplies, contamination of water supplies from environmental disasters, and more recently security threats to water infrastructure.

These types of emergency events can affect developed and developing countries equally. Therefore, the ability to collect and store fresh water when available from a main water supply and maintain the same for a period of time is an oft-overlooked security need that can provide lifesaving access in times of crisis and disorder. Readily available fresh water provides for sustenance and for operation of facilities; however most do not readily appreciate the risk of events that can interfere with running water supplies.

The present invention contemplates a system that address this need, wherein one or more fresh water storage tanks are provided either in the home or stored outdoors and connected to a main water supply. The system draws water and stores the same from the main water supply and can pump the water into the home in times of power loss using a solar water pump. The system continually or periodically replenishes the tanks with water from the main water supply, maintaining a fresh quantity thereof if access to the main water supply ceases or becomes unavailable. The storage of water provides access to a store of fresh water when necessary, wherein several embodiments of the present invention are contemplated to address different configurations that would accommodate various residential and commercial water systems.

DESCRIPTION OF THE PRIOR ART

Devices have been disclosed in the prior art that relate to water distribution and storage systems. These include devices that have been patented and published in patent application publications. These devices generally relate to different systems that allow a tank to be replenished and used when desired; however none are specifically adapted for use when the main water supply is inoperable and when electrical power is not available. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 2,931,382 to Cirillo discloses an emergency water tank device that stores water within a building or dwelling in the event the main water supply is shut off. The tank comprises one of a fiberglass construction, wherein the tank is placed between the main water supply and the rest of the dwelling water distribution system. A check valve is disposed upstream and downstream from the system, along with an air relieving valve in the end wall of the tank. Further provided is a means to fluorinate the water in the tank prior to use. While the Cirillo device is one that stores water within a dwelling, its construction does not contemplate a pressurized system or one that can operate a shower or any appliances as would be possible if the main water supply were still active. The present invention allows users within the dwelling to draw water through the plumbing system and does not contemplate drawing water from the tank manually.

Similar to the Cirillo system, U.S. Pat. No. 3,095,893 to Martin discloses a system for storing water tanks and filling/refilling the same in a multi-level building, such as an apartment or commercial building. An emergency water tank is placed on each floor and is in line with the water supply lines, whereby under normal conditions the tanks are continually replenished. A check valve can freeze the incoming water and an air valve can be opened in each tank such that water can be withdrawn from the individual tanks via a spigot. Similar to Cirillo, the Martin system requires manual dispensing of the water from the tanks. The present invention contemplates a system that operates a dwelling's water supply as it would operate under normal conditions, whereby direct retrieval of water is not required.

U.S. Pat. No. 4,962,789 to Benscoter discloses an emergency water reservoir that is coupled to an existing hot water heater plumbing supply and used to store water from the hot water tank for use when municipal supply is not available. Taps are provided for withdrawing water directly from the water reservoir for drinking and other uses. The Benscoter, rather than tying directly into the main water supply entering the house, draws water into a temporary reservoir from the hot water heater tank. While disclosing a temporary water storage system for emergencies, the construction and the system of the Benscoter diverges from that of the present invention.

Finally, U.S. Patent Publication No. 2013/0037114 to Sudhalkar discloses a system for storing emergency water supplies using a storage tank and a plurality of valves that allow the system to fill the tank or to bypass the tank. The system draws water from the main water pipe and provides an alternate route for water to fill an emergency storage tank and then bypass the same. This configuration shares some elements with the present invention; however, the Sudhalkar device fails to disclose pressurized and non-pressurized system embodiments and the exact arrangement of the present system. Several embodiments of the water storage system are contemplated by the present invention, wherein water is stored in a pressurized or unpressurized state. All embodiments contemplated a water pump device that draws power from a solar photovoltaic cell and battery storage such that the system can function when the main water pipe is not providing water and no electricity is available from the grid.

The present invention comprises a system that stores a quantity of fresh water that can be supplied via pressure from the main water supply or via a water pump. A store of water is maintained within one or more storage tanks and made available to a commercial or residential water system. The system contemplates isolating the water tanks from the main water supply, yet allowing the main water supply to replenish the tanks under normal operating conditions to prevent stagnation. Overall, it is submitted that the present invention diverges in concept and in design from the prior art, and consequently it is clear that there is a need in the art for an improvement to existing fresh water storage systems. In this regard the instant invention substantially fulfills these needs.

SUMMARY OF THE INVENTION

In view of the foregoing disadvantages inherent in the known types of fresh water storage systems now present in the prior art, the present invention provides a new storage system that can be utilized in residential or commercial environments and in times of emergency, wherein no external electrical power is required and the fresh water is continually replenished under normal operating conditions.

It is therefore an object of the present invention to provide a new and improved fresh water storage system that has all of the advantages of the prior art and none of the disadvantages.

It is another object of the present invention to provide a fresh water storage system that receives fresh water from a main water supply and diverges water into one or more storage tanks, whereby the tanks are stored either indoors or outdoors and have varying capacity depending upon the needs of the building/dwelling.

Another object of the present invention is to provide a fresh water storage system that can replenish fresh water supplies within the storage tanks using the free flow of pressurized water from the main water supply, or via a water pump that pumps water through the tanks to remain fresh.

Yet another object of the present invention is to provide a fresh water storage system that contemplates a water pump that draws energy from an electrical storage medium and one that charges itself via solar energy.

Yet another object of the present invention is to provide a fresh water storage system that contemplates a water pump that draws energy from a generator, whereby grid power is not required to draw fresh water from the one or more storage tanks.

Another object of the present invention is to provide a fresh water storage system that either continually or operably replenishes the fresh water within the tanks to prevent stagnation, whereby water pressure from the main water supply is used or the system water pump is utilized.

Another object of the present invention is to provide a fresh water storage system that can be deployed in either a commercial or residential environment, including condensed living environments with multiple residences in one building.

Another object of the present invention is to provide a fresh water storage system that employs fresh water tanks of appropriate size for the space (commercial or residential), whereby the tanks can be stored outdoors, below ground, within the building, and even within individualized dwellings in larger buildings.

Yet another object of the present invention is to provide a fresh water storage system that provides fresh, potable water for users in the event of a disaster, shortage, emergency event, or contamination event of a main water supply.

A final object of the present invention is to provide a fresh water storage system that can be tailored for a specific application, whereby proper isolation of the fresh water tanks is provided and a means to draw the fresh water from the tanks in the absence of grid electrical power is made available.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
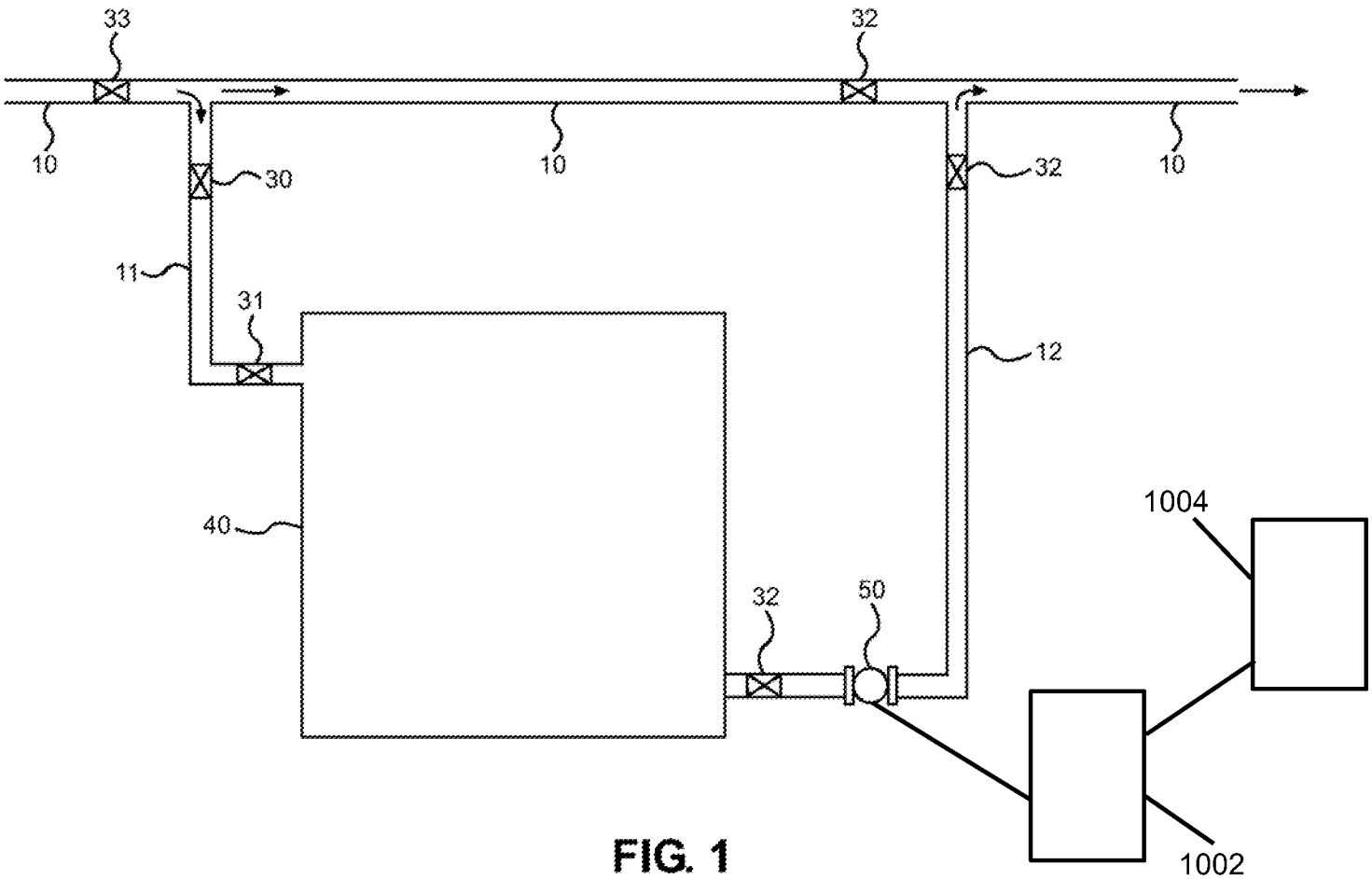
FIG. 1 shows an embodiment of the present invention in which fresh water from the storage tank is operably pumped therefrom in order to replenish supplies.

Reference is made herein to the attached drawings. Like reference numerals are used throughout the drawings to depict like or similar elements of the fresh water storage system of the present invention. For the purposes of presenting a brief and clear description of the present invention, the preferred embodiment will be discussed as used for storing fresh, potable water for subsequent use in the event water supplies from a main water line cease. The figures are intended for representative purposes only and should not be considered to be limiting in any respect.

Referring now to FIG. 1, there is shown a diagram of on embodiment of the present invention. In this embodiment, the system draws fresh water from a main water supply 10 and diverts it into a fresh water storage tank 40. The fresh water storage tank 40 is disposed either indoors or outdoors, and is capable of being isolated from the main water supply 10 in the event of an emergency. From the main water supply 10, a water distribution pipe 11 is connected and used to draw water from the main water supply 10 and direct it into the storage tank 40. The storage tank 40 comprises a large vessel that can support a large quantity of fresh, potable water for longer periods of time without spoilage and leakage. The exact size, shape and design of the tank will take on different forms depending on the given application of the system.

Along the distribution pipe 11 is a first shutoff valve a pressure sensitive valve 31. The first shutoff valve 30 is used to prevent water from entering the distribution pipe 11 from the main water supply 10. The pressure sensitive valve 31 is a pressure sensor valve or a float valve that closes when the tank 40 is filled and pressure builds in the tank 40, thereby preventing excess water from entering the tank 40. Along the main water supply 10 and prior to the distribution pipe 11 is a check valve 33, while an isolation valve 32 is placed downstream from the check valve 33. The isolation valve 32 is placed upstream of the water supply tank return pipe 12, wherein the isolation valve 32 and the shutoff valve 30 are used to isolate the fresh water within the tank 40 once filled, and further prevents water from the main water supply from entering the home.

To fill the tank 40, the shutoff valve 30 is opened and water from the main water supply 10 enters the distribution pipe 11 towards the tank 40. Downstream of the tank 40 and along a low point thereof is the return pipe 12, which allows water to exit the tank 40 for circulation of the tank, replenishment, or for use of the water therefrom. A second isolation valve 32 is disposed on the return pipe 12, along with a water pump 50. The isolation valve 32 can be closed to allow water to fill the tank 40 from the main water supply 10 and distribution pipe 11. Once the tank is filled, the pressure sensitive valve 31 closes and water no longer flows thereinto.

To flush the tank 40, to replenish reserves with fresh water, or to draw water from the tank for direct consumption, the isolation valve 32 of the return pipe 12 is opened and the pump 50 is activated, thereby evacuating the water from within the tank 40 via the return pipe and the main water supply line 10. This operation is conducted manually and the pump 50 is required to draw water from the tank 40. Therefore this system is considered an "unpressurized" embodiment of the system. To refill the tank, the isolation valve 32 of the return pipe 12 is closed and the shutoff valve 30 of the distribution pipe 11 is opened, thereby allowing water to freely enter the tank 40.

Therefore, to replenish water, the tank 40 is first emptied and then refilled using the main water supply line 10. In the event of an emergency, the tank 40 can be isolated by closing the shutoff valve 30 of the distribution pipe 11 and the isolation valve 32 upstream of the return pipe 12 on the main line 10. The pump 50 is then able to evacuate water from the tank and into the home through the main water line 10. The water in the main line 10 can be cleared prior to this procedure by closing the isolation valve 32 of the return pipe and evacuating any water in the main line 10 upstream of both isolation valves 32 just downstream of the junction of the return pipe 12.

Figure 2:
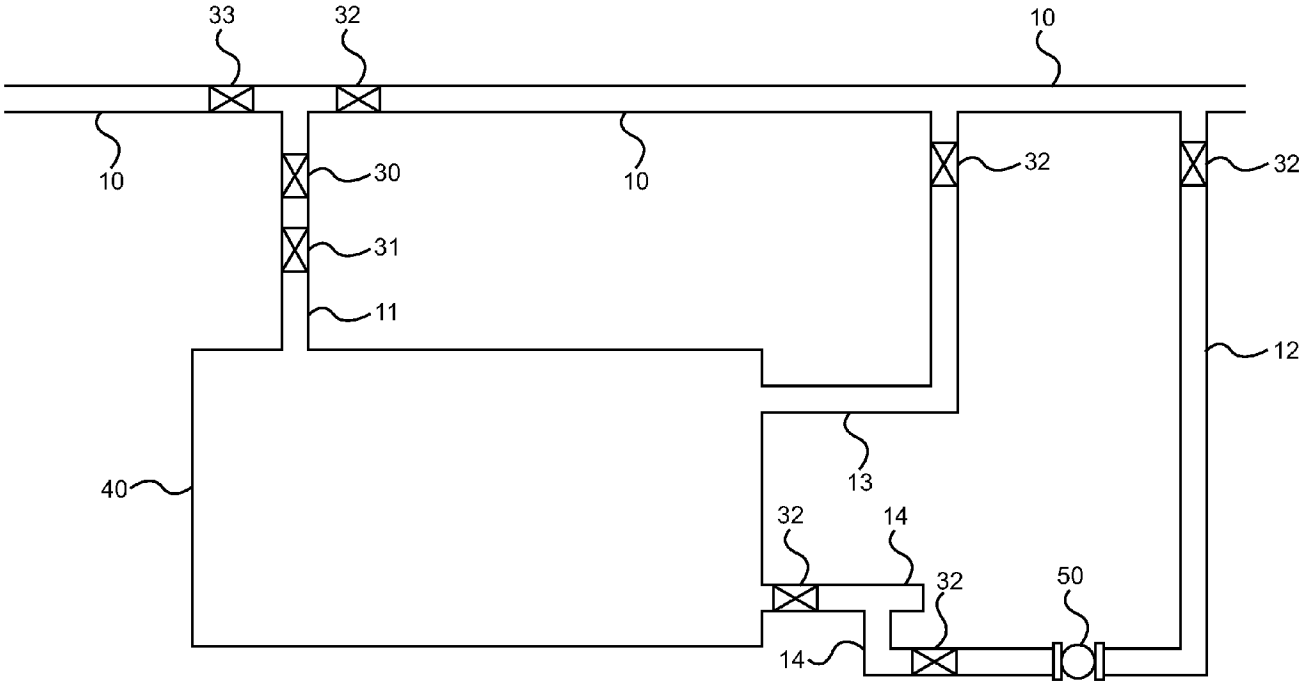
FIG. 2 shows an embodiment of the present invention in which fresh water from the storage tank is either operably pumped therefrom or water pressure from the main water supply line is used to replenish supplies.

Referring now to FIG. 2, there is shown another embodiment of the fresh water storage system of the present invention, wherein a second, pressurized return pipe 13 is provided between the storage tank 40 and the main water supply line 10. In this configuration, the same system as shown in FIG. 1 is presented, however an additional return pipe 13 is provided from the tank 40 to the main line 10 such that the tank can be recirculated and replenished without running the water pump 50. Specifically, a shutoff valve 30 and a pressure sensitive valve 31 are provided along the distribution pipe 11 extending between the main line 10 and the tank 40, and the same first return pipe 12 and pump setup are provided downstream from the tank. Water from the tank 40 can be pumped via the water pump 50 and the first return pipe 12, whereby one or more outlet pipes 14 may also be provided from the tank to secure one or more pumps thereto.

In addition to pumping water from the tank 40, the embodiment of FIG. 2 allows the pressurized water from the main water supply line 10 to evacuate the tank 40 and replenish the water therein. This is accomplished by closing the isolation valve 32 along the first return pipe 12 and opening the isolation valve 32 along the second return pipe 13. When the shutoff valve 30 of the distribution pipe 11 is opened, water enters the tank 40 from the main 10 and is pressurized, whereby the water then is evacuated through the second return pipe 13 and back into the main line 10. The user can therefore flush the tank, replenish the supply of water, refill or otherwise flow water through the tank 10 without the water pump 50 in this manner. However, in the event of an emergency, the shutoff valve 30 and the isolation valve of the second return pipe 13 can be closed, and the water pump 50 can be used to draw water from the tank 40 for use in the home or building.

Figure 3:
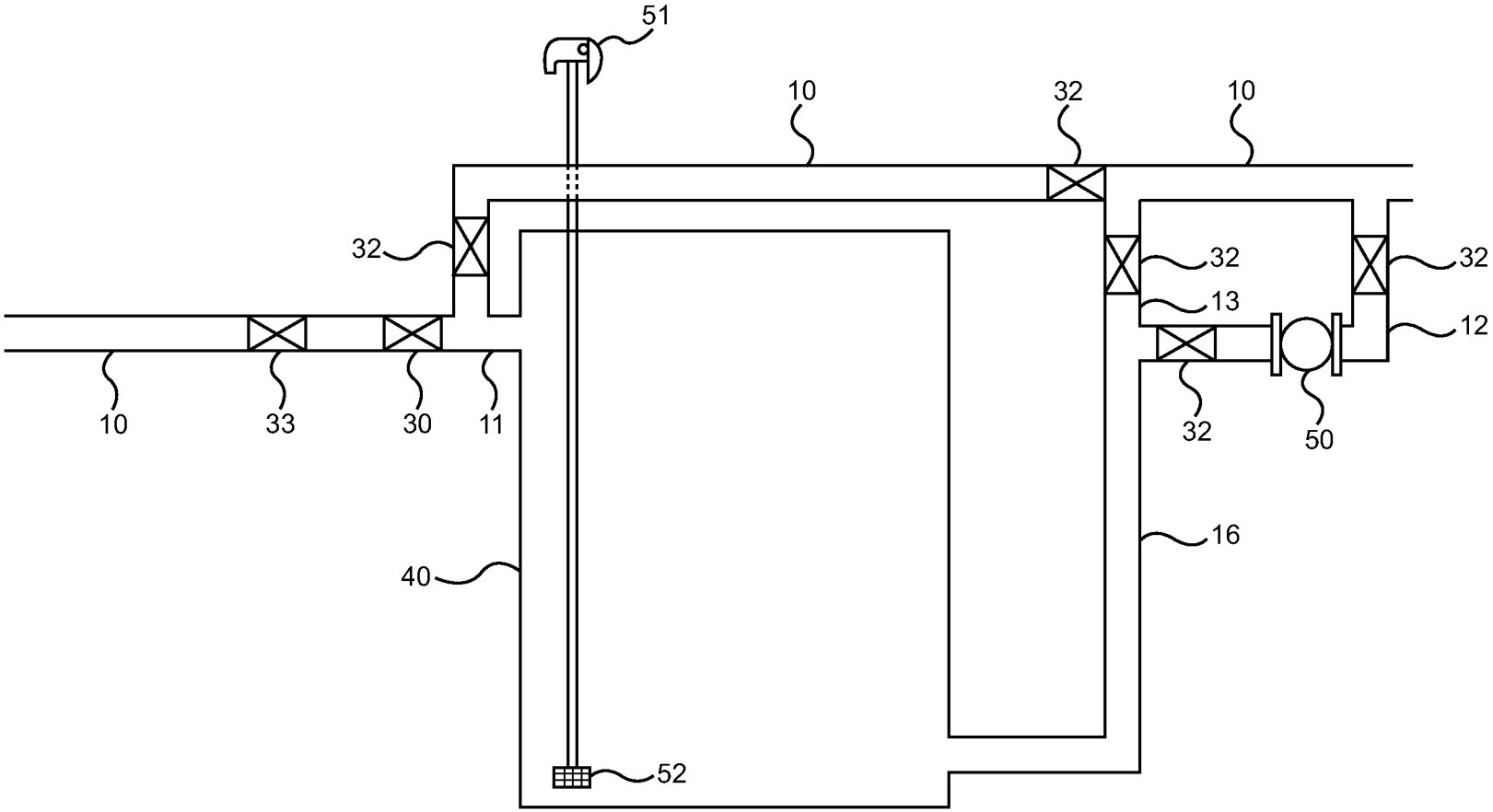
FIG. 3 shows an embodiment that can be buried outside and an external pump can be used to draw water from the tank.

Referring now to FIG. 3, there is shown yet another embodiment of the system, where the same configuration as FIG. 2 is provided, however the water storage tank 40 is buried below ground and a supplementary water pump 51 is provided. This auxiliary pump 51 allows a user to draw water from the tank 40 directly, in a similar manner as a water well while outdoors. This pump can be used when the tank 40 is isolated and direct access to the water supply is desired. Upstream of the tank 40 is the distribution pipe 11 connecting the tank 40 to the main water supply 10. Exiting the pump is one or more return pipes 13, 12 that may directly connect to the tank 40 or be connected to a singular return pipe 16 and separate into individual branches. The two contemplated returns include the pressurized return pipe 13 with an isolation valve 32, and the first return pipe 12 that includes at least one isolation valve 32 and a water pump 50. Both return pipes 12, 13 connect to the main water supply line 10 downstream of the tank 40 and downstream of the main isolation valves 32 and check valve 33. The shutoff valve 30 may be placed along the distribution pipe 11 or along the main water line 10, or alternatively both may have their own individual shutoff valve.

The isolation valves and the shutoff valves may comprise similar constructions, wherein each comprises a hand-turnable or electronically controlled valve that opens and closes to cease water transport therethrough to a given sector of the system. Isolation valves work in the same was as shutoff valves, wherein the goal is to allow water to either bypass the water storage tank 40 and flow into the home through the main water line 10, divert water into the tank and bypass a portion of the main water line 10, or finally to shut off the water supply from the main water line 10 altogether. This final option is used when the municipal or well water is contaminated or otherwise unusable, and supplies stored in the tank 40 are preferable. Once the main line 10 is stopped and prevented from entering either the home or the tank, the tank water can be safely withdrawn using a water pump.

Figure 4:
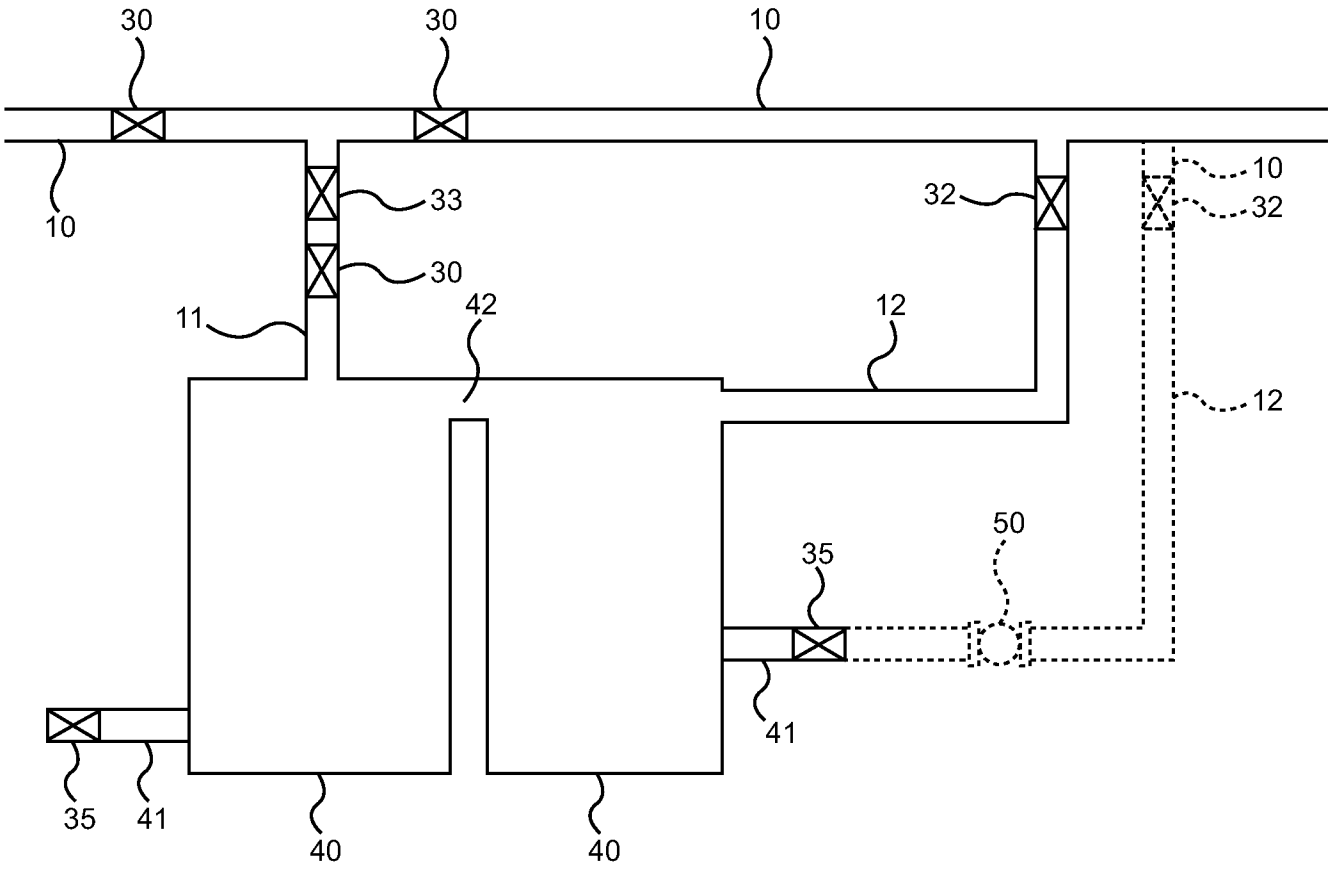
FIG. 4 shows an embodiment with multiple storage tanks in series and individualized drains therefrom.

Referring now to FIG. 4, a final configuration is shown, wherein more than one water storage tank 40 is deployed and connected via an intermediate tank-connecting pipe 42. In this configuration, each is filled from the same distribution pipe 11, wherein the system can be setup to be replenished using the pressure from the main water supply line 10 or the system can rely on individual pumps 50 attached to each tank 40. The tanks are aligned in series and fill to a given level, whereafter the tanks can be isolated by the valves 30, 33. Water from each tank 40 can be withdrawn from individual drains 41, each having their own valve 35 to withdraw water. Additionally, a return pipe 12 can be secured to each tank 40, along with a water pump 50 to withdraw water from each tank.

The configuration of FIG. 4 is suitable for a multi-tank setup, wherein several tanks allow each tank to be isolated.

This is suitable for condensed living dwelling s (i.e. apartment buildings, etc.), for commercial environments, and for dwellings wherein the user wishes to have multiple tanks 40. The system operates the same as previously disclosed, however each tank stores water and is individually drained. Each tank may have a return pipe 12 connecting back to the main 10, or alternatively the water can be withdrawn directly from the tanks via their local drains 41.

As shown in FIGS. 1 through 4, the system requires several isolation 32, shutoff 30 and pressure sensitive valves 33 in order to properly isolate the tanks 40. The exact configuration and positioning of the valves may take on several forms. However, the tanks can be replenished using one of two methods: (1) using pressure from the main water supply line (see FIG. 2), and (2) using a water pump or natural draining to first empty the tank after first isolating the tank from the main water supply. The tank can then be refilled when the isolation is removed in option (2). Option (1) allows continuous replenishment of the fresh water in the tank, while option (2) requires the tank to first be drained completely before being refilled.

Furthermore, it is contemplated that the water pump of the present invention may take on several forms, wherein each form falls within the scope of being powered without grid electricity. The two primary embodiments contemplate a solar powered assembly and an assembly powered by a combustion generator. The first embodiment contemplates an electric pump driven by electrical power stored within batteries (schematically shown at 1002 in FIG. 1), wherein the batteries 1002 are charged via photovoltaic cells (schematically shown at 1004 in FIG. 1). The second embodiment contemplates an electric pump that is powered by a generator. In both embodiments, the pump is driven without electrical power from the grid, which is essential in a power outage situation.

Clean water is an essential resource, and most people rely on water that is pumped through systems from remote sources. During power outages, natural disasters, and miscellaneous catastrophes, water sources may become contaminated or unavailable. Some people may keep water in a storage tank, but this water sits stagnant and loses its freshness. Such storage tanks have to be regularly drained, cleaned, and refilled, even if the water has not been used. The present invention describes an emergency water supply system that stores and dispenses clean water for emergency use that can operate independently of municipal or well water, and one that can deliver water without electrical power from the grid.

Overall it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A water storage system for storing local water supplies, comprising:

one or more fresh water storage tanks adapted to receive and store a quantity of water;

said one or more fresh water storage tanks connected to a water distribution pipe that is connected to a main water supply line receiving water at pressure from a municipal water supply;

said fresh water storage tanks reconnecting to the main water supply line downstream from said water distribution pipe using at least a first return pipe;

a water pump disposed downstream of the one or more fresh water storage tanks, said water pump configured to draw water from the one or more fresh water storage tanks through the at least a first return pipe;

at least a first valve in the water distribution pipe upstream of said water storage tanks;

at least a second valve in the main water supply line downstream of the water distribution pipe and upstream of the return pipe;

at least a third valve in said return pipe adapted to isolate said return pipe from water flowing through the main water supply line from the municipal water supply;

the at least a first valve in the in the water distribution pipe and the at least a second valve in the main water supply line downstream of the water distribution pipe and upstream of the return pipe adapted to isolate said fresh water storage tanks from water flowing at pressure into said main water supply line from the municipal water supply.

2. The water storage system of claim 1, further comprising:

at least one second return pipe having an isolation valve between said water storage tank and said main water supply line, said second return pipe reconnecting to said main water supply line downstream from said water distribution pipe.

3. The water storage system of claim 1, wherein:

said one or more fresh water storage tanks are underground and further comprise an auxiliary pump to draw water therefrom.

4. The water storage system of claim 1, wherein said one or more fresh water storage tanks further comprise individual drains to draw water therefrom.

5. The water storage system of claim 1, wherein:

said first valve upstream of said water storage tanks further comprises a check valve and a shutoff valve.

6. The water storage system of claim 1, wherein:

said one or more fresh water storage tanks further comprise more than one fresh water storage tank connected in series via intermediate tank-connecting pipes;

said more than one fresh water storage tanks disposed between said water distribution pipe and a return pipe;

each of said fresh water storage tanks having individual drains to draw water therefrom.

7. The water storage system of claim 1, further comprising at least a fourth valve, the at least a fourth valve disposed in the water distribution pipe, said at least a fourth valve comprising a pressure sensitive valve configured to close when a pressure in the water storage tanks exceeds a threshold pressure.

8. The water storage system of claim 1, wherein the water pump receives power from a power source disconnected from an extant power grid.

9. The water storage system of claim 8, wherein the power source comprises at least one storage battery.

10. The water storage system of claim 9, wherein the at least one storage battery is charged by a solar panel adapted to generate electrical energy suited for powering the water pump.

* * * * *